US007647956B1

(12) United States Patent
Cona et al.

(10) Patent No.: US 7,647,956 B1
(45) Date of Patent: Jan. 19, 2010

(54) PORTABLE CARPENTRY WORKSHOP

(75) Inventors: Fred Cona, Brooklyn, NY (US); Peter Reuss, Bayshore, NY (US)

(73) Assignee: Rolling Trades Inc., Bayshore, NY (US)

( * ) Notice: Subject to any disclaimer, the term of this patent is extended or adjusted under 35 U.S.C. 154(b) by 151 days.

(21) Appl. No.: 12/034,015

(22) Filed: Feb. 20, 2008

(51) Int. Cl.
*B25H 1/00* (2006.01)

(52) U.S. Cl. ..... 144/286.5; 83/471; 83/477.2

(58) Field of Classification Search ..... 144/285–287; 83/469, 471, 477, 477.2, 471.2, 471.9, 479, 83/490; 108/157.1
See application file for complete search history.

(56) References Cited

U.S. PATENT DOCUMENTS

| | | | | | |
|---|---|---|---|---|---|
| 2,490,588 | A | * | 12/1949 | Haloski et al. | 296/22 |
| 4,546,804 | A | * | 10/1985 | Haeger | 144/1.1 |
| 4,640,326 | A | * | 2/1987 | Hewitt | 144/287 |
| 4,874,025 | A | | 10/1989 | Cleveland | |
| 4,909,491 | A | | 3/1990 | Cheng | |
| 5,320,150 | A | * | 6/1994 | Everts et al. | 144/287 |
| 5,383,977 | A | | 1/1995 | Pearce | |
| 5,592,981 | A | | 1/1997 | Derecktor | |
| 5,868,185 | A | | 2/1999 | Poling | |
| 5,875,828 | A | | 3/1999 | Quiram | |
| 6,058,990 | A | | 5/2000 | Kent | |
| 6,439,280 | B1 | * | 8/2002 | Wang | 144/287 |
| 6,546,978 | B2 | * | 4/2003 | Thoman | 144/286.1 |

* cited by examiner

*Primary Examiner*—Shelley Self
(74) *Attorney, Agent, or Firm*—Boris Leschinsky

(57) ABSTRACT

A portable rolling carpentry workshop includes a table saw mounted on a sliding means to allow the blade of the saw to be shifted to the left or to the right of the longitudinal centerline of the workshop so that more supporting surface is available on either side of the blade to allow cutting large workpieces on a relatively narrow tabletop surface. The workshop of the invention is sized to allow easy maneuvering through the narrow hallways of apartment buildings but affords the functionality of larger worktables due to this unique ability to slide the table saw. Also provided is an extendable miter saw table located above the main tabletop surface and allowing passing of the longer workpieces underneath thereof when ripping with table saw. Therefore the use of both the table saw and the miter saw can be accomplished at the same time without the need to rearrange the configuration of the power tools on the workshop.

8 Claims, 16 Drawing Sheets

PORTABLE CARPENTRY WORKSHOP

BACKGROUND OF THE INVENTION

This invention relates to portable workshop systems of multi-functional use in connection with building work, carpentry and the like. Known, easily transportable systems for the clamping and handling of workpieces and/or the support or guidance of power tools are limited in their capacity to deal with larger work material. They are also limited in their versatility; clamping tables do not provide adequate saw table functions, saw tables do not provide adequate clamping table functions and neither provide drill table functions. They further are limited in their ability to maneuver through the narrow hallways of apartment buildings.

There are many portable worktables and workshops described in the prior art showing the arrangements with extendable supports designed to allow the carpenter to work with longer workpieces. Typically these supports are designed to extend lengthwise along the workshop top surface. U.S. Pat. No. 6,568,308 for example shows a worktable with longitudinally extendable supports allowing mounting of a circular saw underneath the surface of the table.

U.S. Pat. No. 6,058,990 incorporated herein by reference in its entirety describes a worktable concept allowing moving the saw on the table in order to increase the support area for various size pieces to be cut. In particular, FIG. 30 and FIG. 31 show different positions of the circular saw on the table. Importantly, this patent specifically describes the steps of varying the position of the circular saw along the length of the table, such that the entire length of the table can be used to support a wider workpiece such as a sheet of plywood. The limit of this approach is that the workpiece in that case is not supported along its own length as the narrow worktable has a very limited ability to support the front and the back of the workpiece as it is moved through the saw while cutting.

Other examples of similar designs can be found in the following patents: U.S. Pat. No. 5,875,828 and U.S. Pat. No. 5,592,981 also show designs of portable worktables with means allowing longitudinal sliding of the circular saw. U.S. Pat. No. 5,868,185 shows a saw supported such that it can travel across the table in order to cut the stationary clamped down workpiece, along with adjustable positioning means along the table. U.S. Pat. No. 4,909,491 shows a worktable with laterally adjustable clamping means. U.S. Pat. No. 5,383,977 shows an expandable workbench where the extending element is adapted to receive a power tool such as a table saw or miter saw. U.S. Pat. No. 4,874,025 shows a miter saw stand with extendable supporting means.

All prior art worktables do not allow to cut large pieces of wood using a variety of saws (such as a miter saw and a table or circular saw for example) all at the same time without the need to rearrange the power tools on the table. While wider worktables are more convenient to cut larger workpieces, they are more difficult to bring in and out of the workplace, especially in apartment buildings. Narrow worktables suffer from limited support they provide for the workpiece while it is being cut.

The need therefore exists for a workshop design allowing for small size, greater maneuverability and greater support for larger workpieces while they are being worked on by the carpenter.

SUMMARY OF THE INVENTION

Accordingly, it is an object of the present invention to overcome these and other drawbacks of the prior art by providing a novel portable rolling carpentry workshop allowing for simultaneous use of more than one power saw and working with a large workpiece such as lumber or a sheet of plywood.

In general terms, the present invention addresses the need for providing an integrated system in which the workshop combines the functions of a clamping table and/or a circular saw table and/or a drill or miter saw table, in which the capacity to handle larger size material in all the mentioned functions is more than double that of known systems and in which for easy carrying and transport the folding state of the system is more compact than that of known apparatus.

This invention satisfies several objectives that are normally difficult to achieve all in the same device:

- Allows to cut large pieces of wood such as plywood sheets and long pieces of lumber
- Allows to use both the table saw and the miter saw all at the same time and without constantly rearranging the workshop configuration
- Provides for dust collection
- Provides many storage compartments
- Provides many accessories such as lighting and power strips
- Provides added shelving for rolling other materials and equipment (when removed—acts as another table top)
- Provides an added foldable table, which can be used as a worktop or for drawings
- Allows to fold the tools and lock up the workshop for the night in a compact configuration
- Provides a foldable router table
- Has narrow width for easy moving through narrow hallways
- Provides roller supports and fork lift attachments to easy transport on and off the truck.

According to the present invention, there is provided a portable carpentry workshop comprising a main structural body with a tabletop and a recess portion adapted to slidingly support a portable table saw such that the sawing table of the table saw is aligned with the tabletop of the workshop and an optional outfeed table forming an extended sawing tabletop surface. The workshop of the invention is characterized by a width and a length. To provide for greater maneuverability, the width of the workshop is limited to be less than two and a half feet. This allows the workshop to be rolled through narrow hallways of the apartment building work sites. At the same time, the length of the worktable is made to be at least two times greater than the width, preferably over five feet.

According to the first aspect of the invention, the blade of the table saw is oriented along its length such that ripping long pieces of lumber can be done with ease. However, the narrow width would normally limit the width of the workpiece that can be ripped by a table saw. In traditional designs, the blade of the table saw is located in the middle section of the table so that only one half of the tabletop surface or less is available for supporting the workpiece on either side of the blade while ripping. Cutting a sheet of plywood for example would be difficult in that case and may require the help of an assistant to support the workpiece while it is being cut. The present invention addresses this difficulty by providing a table saw sliding means allowing the table saw itself and therefore its blade to be moved to the left or to the right of the longitudinal center line of the workshop. This novel shifting of the table saw position allows the carpenter to maximize the support of the workpiece using the entire tabletop surface. This design allows the ripping of both long and wide workpieces using the narrow tabletop surface of the workshop.

According to the second aspect of the invention, the carpentry workshop of the invention is further equipped with an extendable miter saw table supporting a miter saw. This table is located above the sawing tabletop surface such that it does not interfere with the action of ripping lumber on the table saw in either folded or extended configurations. The novel location of the miter saw table above the main tabletop surface allows the carpenter to use both the miter saw and the table saw at the same time without the time-consuming need to rearrange the configuration of the workshop, which is typically required in other designs of multifunction workshops.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

Figure 1:
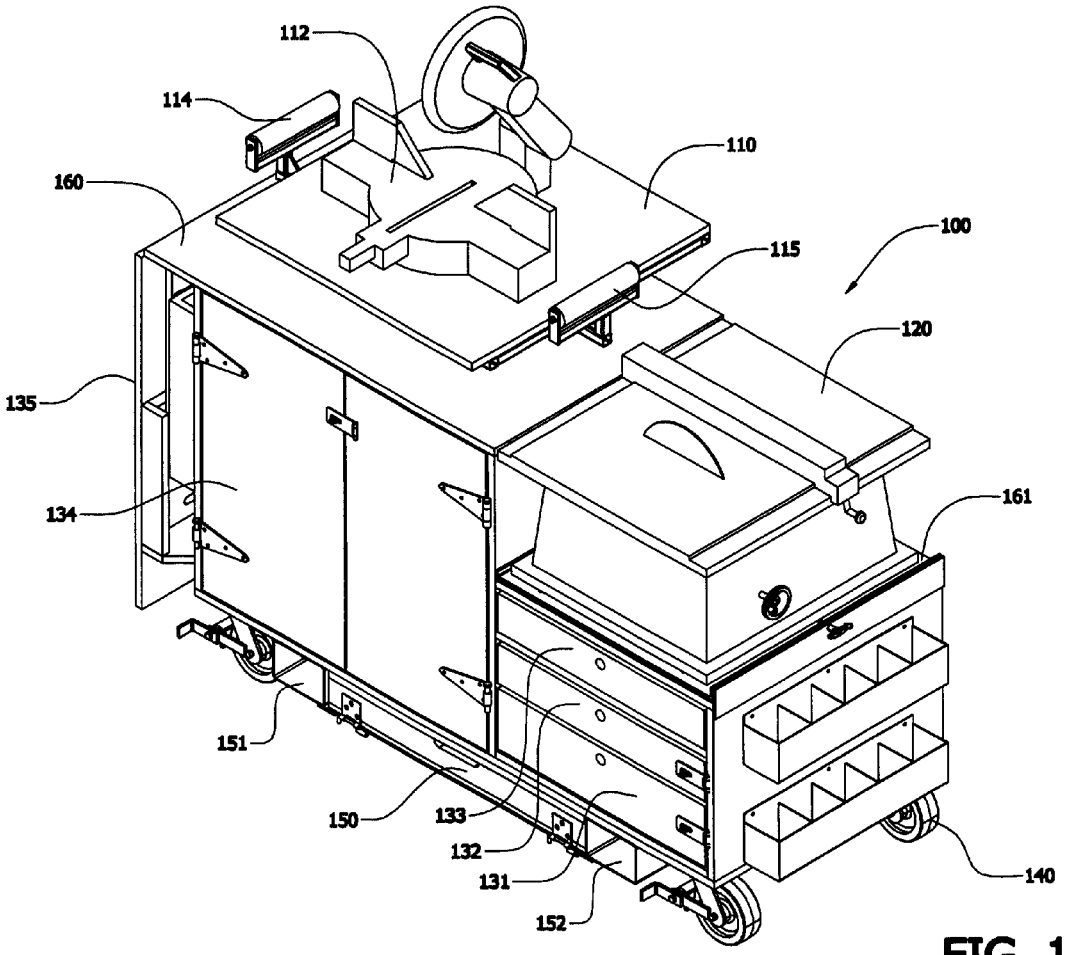
FIG. 1 is an all-closed top right isometric view of the carpentry workshop of the invention from its front.

A detailed description of the present invention follows with reference to accompanying drawings in which like elements are indicated by like reference letters and numerals.

The carpentry workshop 100 of the invention is now described referring to FIGS. 1-6 showing the all-closed configuration of the device. The main structural body is equipped with the top surface of the workshop, which has two tiers: the tabletop portion 160 is located next to the recess portion 161 sized to accept a standard 10' table saw 120. When the table saw 120 is in place, the top of its own saw table is located at the same level as the tabletop surface 160 forming in combination the main sawing tabletop surface of the workshop. On the sides of the workshop there are located numerous storage compartments and drawers, such as drawers 131, 132, and 133; storage area with doors 134, a sliding drawer/step 150, and possibly others. Of note here is that in the preferred configuration of the device, the top storage drawer 133 also serves as sawdust collector as will be described in more detail below.

Additional advantageous provisions include providing the forklift inserts 151 and 152 located on both sides of the lower drawer/step 150 and sized to accept the standard forklift and facilitate loading the device on and unloading off the truck for transportation to the work site. Locking casters 140 are located at the outer four corners of the workshop and are sized to support the weight of the device and all accessories. In the preferred configuration, the casters have 6" wheels.

The width of the workshop is selected such that it can be moved through narrow hallways of apartment buildings and other similar work sites. On the one side, the width should be less than two and a half feet to facilitate moving the workshop from site to site. On the other hand, it should not be less than a standard width of the table saw. In its preferred configuration, the width is selected to be between 24 and 28 inches, most preferably about 26 inches. The length of the device is selected to be at least twice that of width such that longer pieces of lumber can be supported on the tabletop surface adequately. In its preferred configuration, the length of the workshop is about five to seven feet, most preferably about 72 inches.

Figure 2:
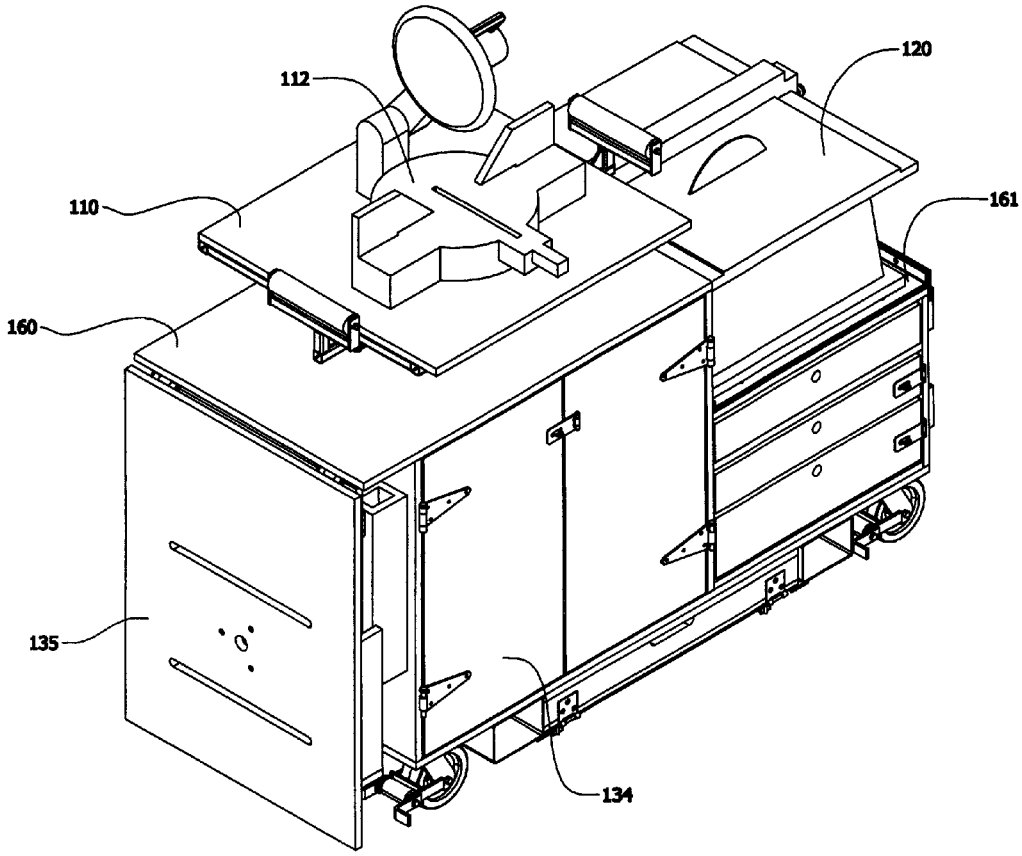
FIG. 2 is an all-closed top left isometric view of the carpentry workshop of the invention from its front.
Figure 3:
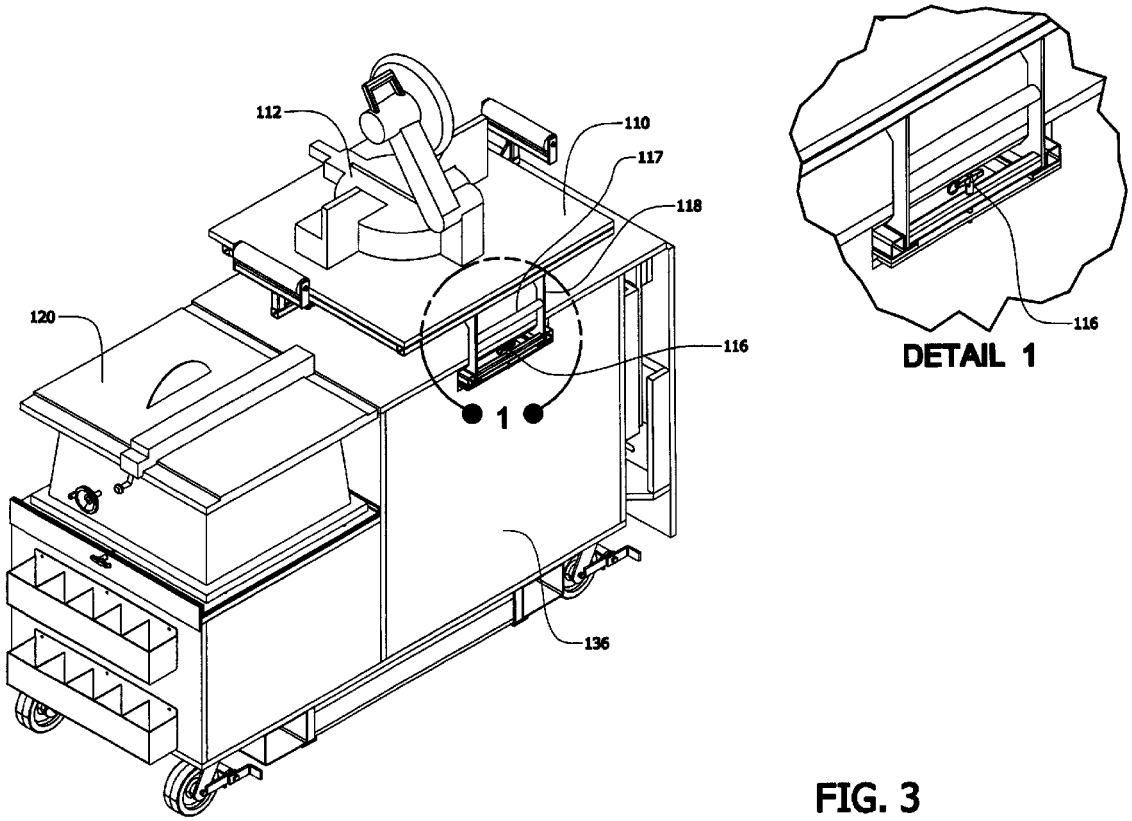
FIG. 3 is an all-closed rear isometric view of the carpentry workshop of the invention, detail 1 showing the pull pin.
Figure 4:
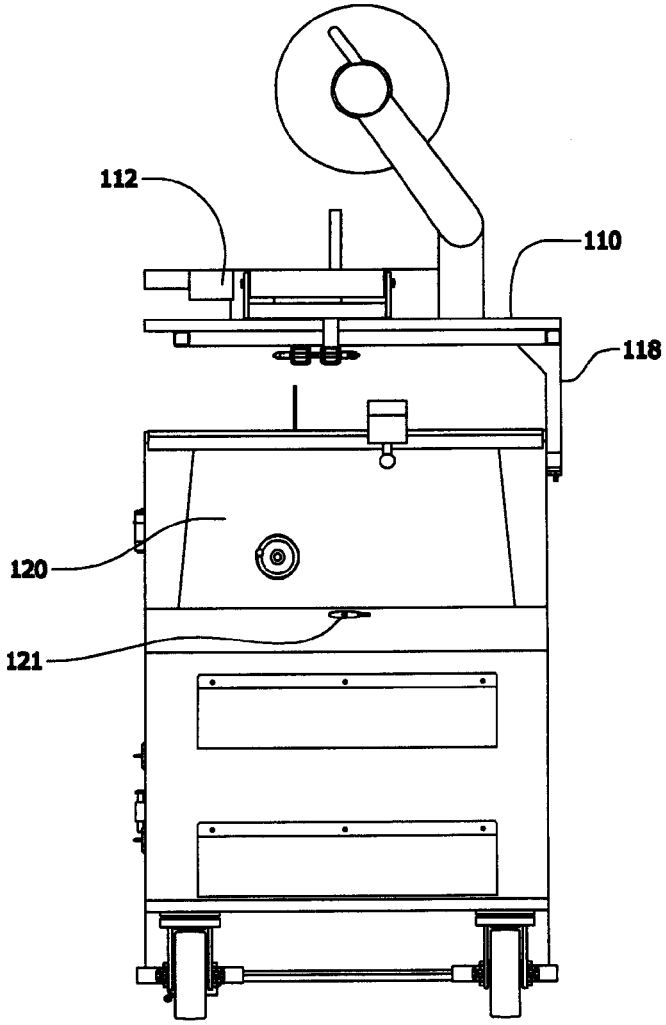
FIG. 4 is an all-closed left side view of the carpentry workshop of the invention.
Figure 5:
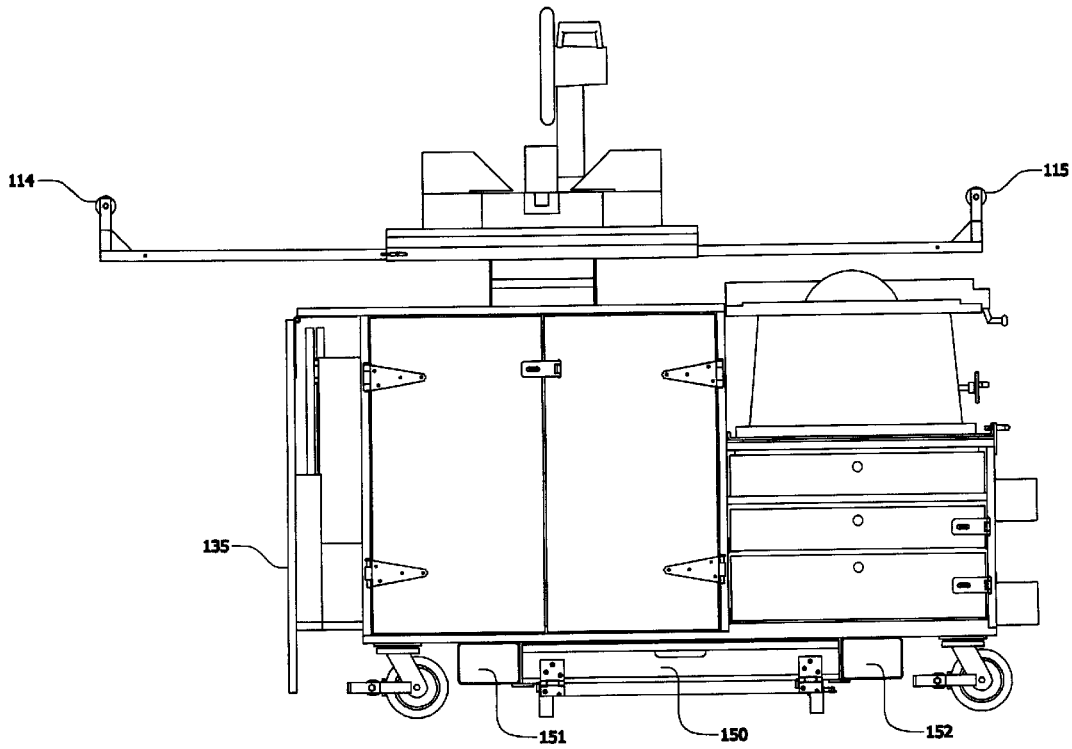
FIG. 5 is an all-closed front view of the carpentry workshop of the invention.
Figure 6:
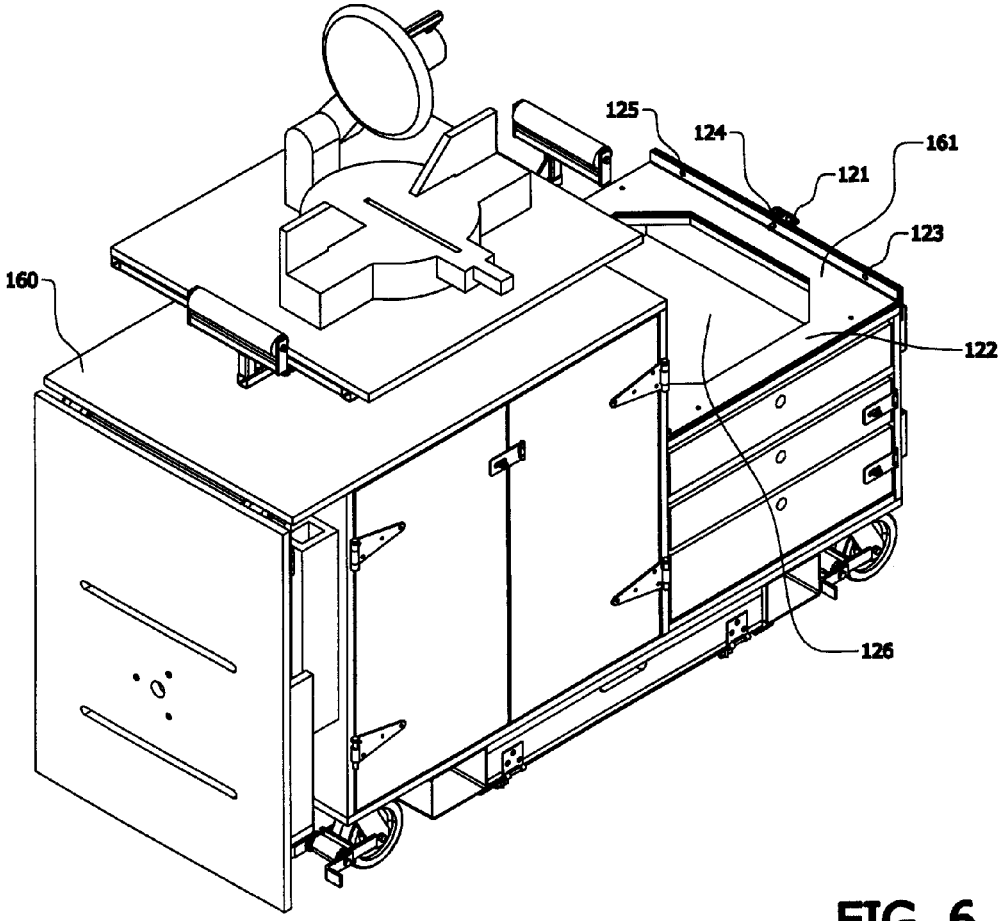
FIG. 6 is a top left isometric view of the carpentry workshop of the invention without the table saw.

The table saw 120 is placed on the carpentry workshop 100 with its blade oriented along the longitudinal centerline of the device. This is an important feature of the invention as it allows for ripping longer wood pieces using just the workshop tabletop surface alone without side table extensions. When ripping even longer workpieces, a longitudinal extension outfeed table 135 can be used. This outfeed table 135 may be also optionally equipped with mount openings for a router base or various clamping means as best seen in FIG. 2. The length of the outfeed table 135 is about 30 inches so when extended it provides a substantial lengthwise addition to the tabletop surface of the workshop.

Figure 13:
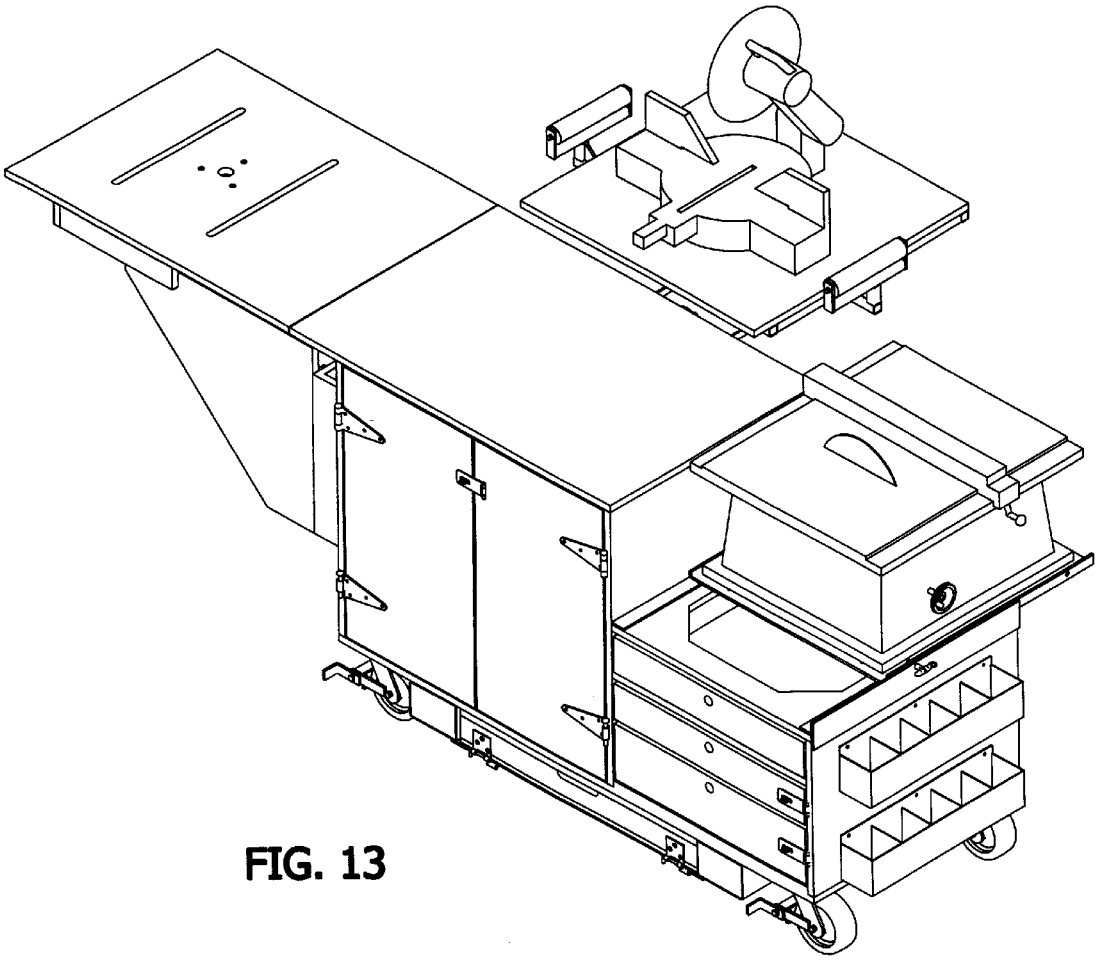
FIG. 13 is a top right isometric view of the carpentry workshop with the table saw shifted to the right.
Figure 14:
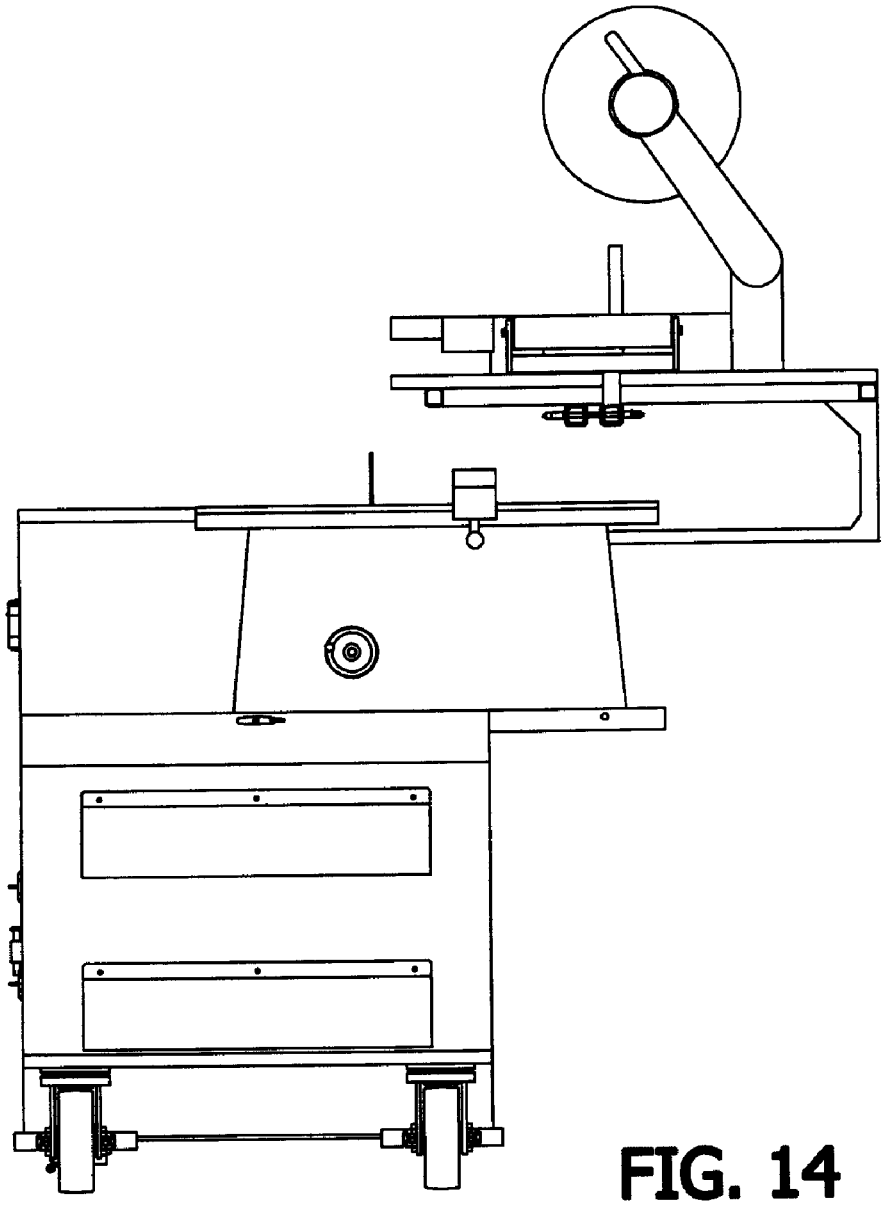
FIG. 14 is the side view of the same.
Figure 15:
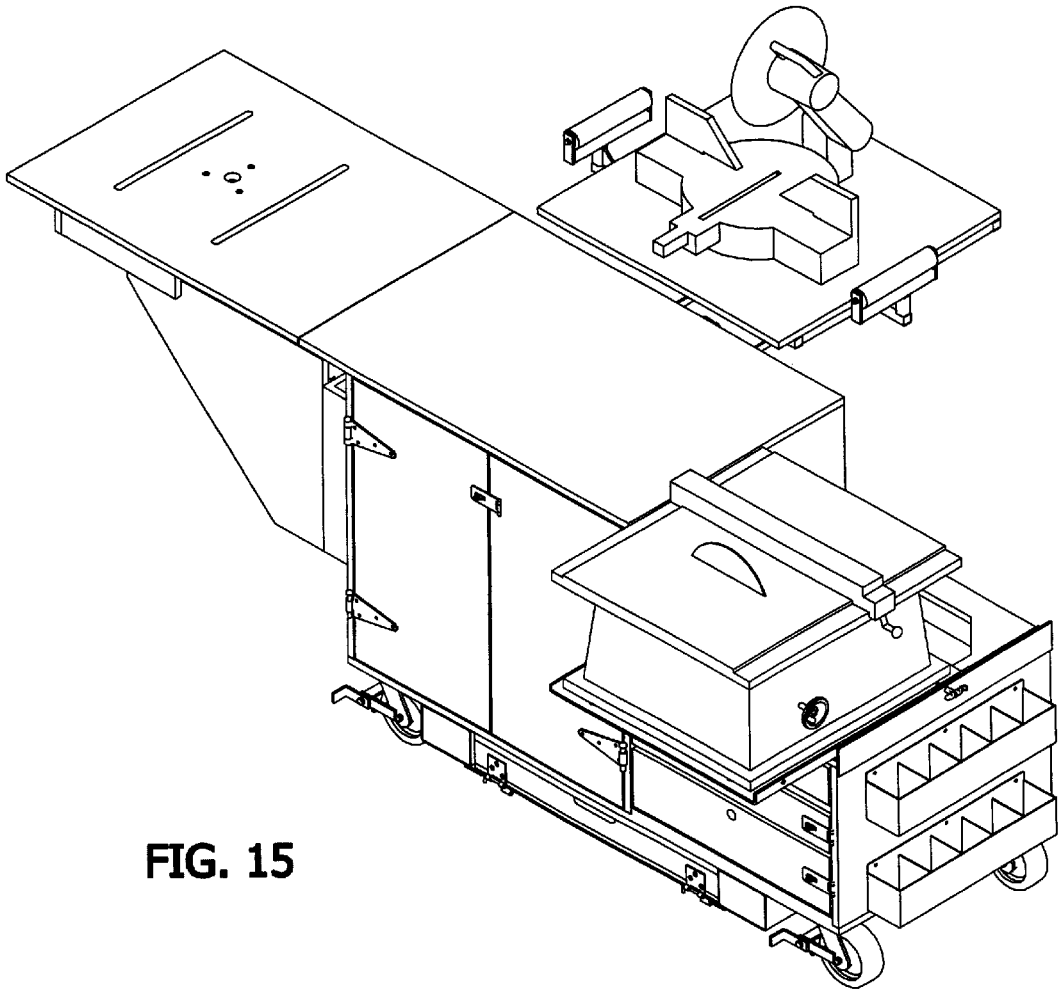
FIG. 15 is a top right isometric view of the carpentry workshop with the table saw shifted to the left.
Figure 16:
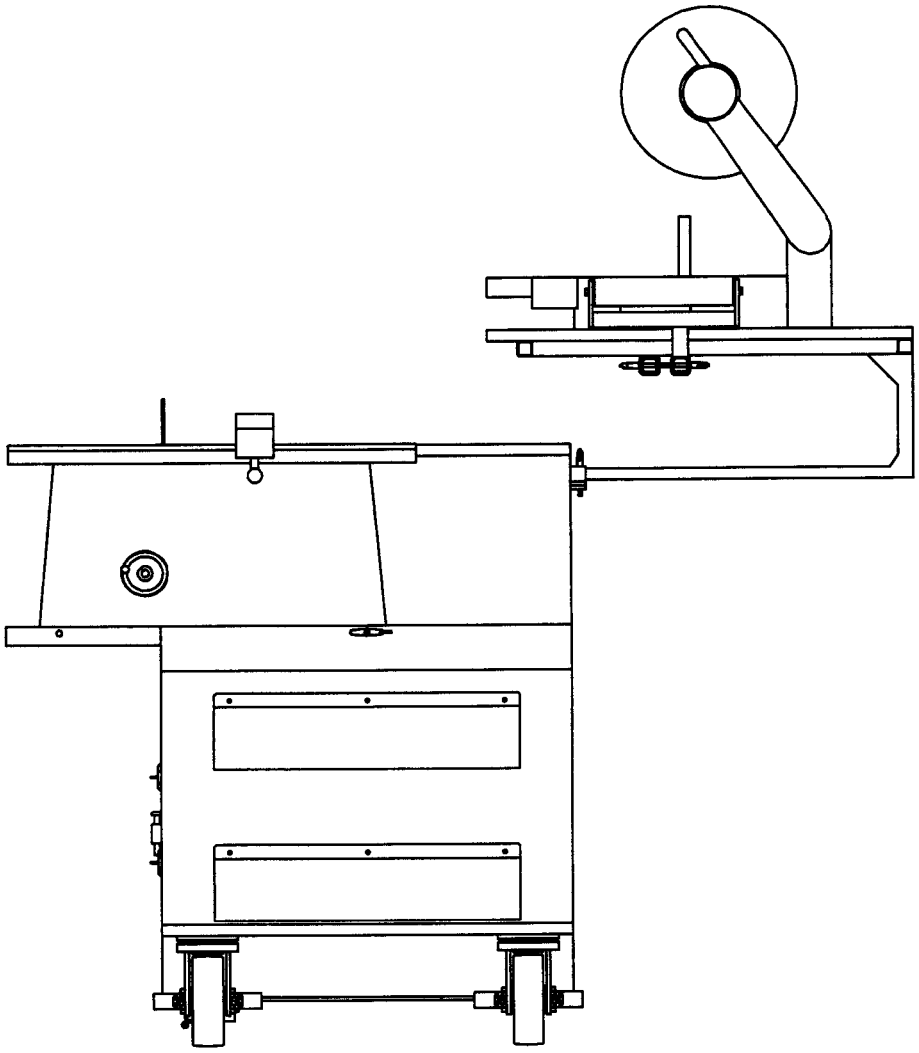
FIG. 16 is the side view of the same.

A key feature of this invention is the ability to shift the position of the table saw to the left and to the right from its normally centered position on the workshop frame. For the purposes of this description, the terms "left" and "right" when used to describe the position of the table saw, refer to its deviation to one side or another from the middle position along the longitudinal centerline of the workshop. For that purpose, the recess portion 161 is equipped with a sliding means 122 as shown in greater detail on FIG. 6. When the table saw 120 is placed on top of the sliding means 122, it can be shifted from its centered position by sliding the sliding means 122 either to the left or to the right. In its preferred configuration, the sliding means is a mounting plate optionally supported on bearing means (not shown) and equipped on its side with a quick-release pin 121 attached to the rim of the main frame of the workshop 100 and adapted to fix the position of the mounting plate relative to the workshop 100 in one of three positions: left, center, or right. Openings 123, 124, and 125 in the corresponding rim of the mounting plate define these three respective positions of the mounting plate and are adapted to accept the pin 121. When one of these openings is aligned with the pin 121, it can be inserted therethrough and therefore fix the mounting plate in place. Pulling on the pin 121 allows the carpenter to release the mounting plate from its current position and shift it to a new position as desired. FIGS. 13 and 14 show the table saw shifted all the way to the right of the workshop while FIGS. 15 and 16 show it shifted all the way to the left. Alternate suitable position adjusting means are also contemplated within the scope of this invention including many known means allowing to infinitely adjust the position of the mounting plate for example with a tightening screw operable to lock the mounting plate in place at any desired location between the most left and the most right.

Another advantageous provision of the present invention is the presence of the saw dust collecting opening 126 in the mounting plate 122 under the table saw 120. Saw dust will drop through this opening into the top drawer 133. Opening of the drawer allows easy removal of the collected saw dust and cleaning the device after use, therefore reducing the amount of time needed for clean-up of the workshop.

A further key novel feature of the present invention is the extendable miter saw table 110 having a miter saw 112 and located above the main tabletop surface 160 of the device supported by a pair of extenders 118. The miter saw table is raised above the main tabletop surface by about three to ten inches in order to allow passing lumber pieces underneath thereof while ripping them using the table saw 120. This height offset is selected to be large enough for reasonable size pieces of lumber to fit thereunder but not to be excessively high as to make its use difficult for a carpenter standing nearby the workshop. Optional step/drawer 150 is also envisioned to help reach the miter saw table 110 in a convenient way for the carpenter. In the preferred configuration of the device, the miter saw table 110 is raised about four and a half inches above the main tabletop surface 160 as defined by the length of the extenders 118. Raising the miter saw table above the main tabletop surface of the device allows inclusion of the miter saw table into the overall configuration of the workshop without the increase in the overall footprint of the device when it is folded for transportation or storage.

The miter saw table 110 is extendable away from the main tabletop surface by releasing the pull pin 116 (see FIG. 3 and the enlarged detail 1) and pulling out the miter saw table using the handle 117. Sliders 119 allow the table 110 to extend all the way out and away from the main tabletop surface 160 as seen best on FIG. 10. The ability to pull the miter saw table 110 away from the tabletop surface 160 allows the carpenter to use both the table saw 120 and the miter saw 112 at the same time without the need to rearrange the configuration of the workshop 100. Pulling the miter saw table 110 all the way out provides for maximum ripping capacity of the workshop To further facilitate the operation of the miter saw 112, extendable left and right outfeed supporting rollers 114 and 115 are provided as part of the miter saw table 110. They are each supported by conventional sliding means such as for example a one-inch square steel tube slidingly placed inside a one-and-a-quarter-inch square steel tube attached in turn to the bottom of the miter saw table 110 as shown on FIG. 4. These rollers can be individually extended by releasing their corresponding pull pins to provide additional support for cutting longer workpieces as shown on FIG. 5.

Figure 7:
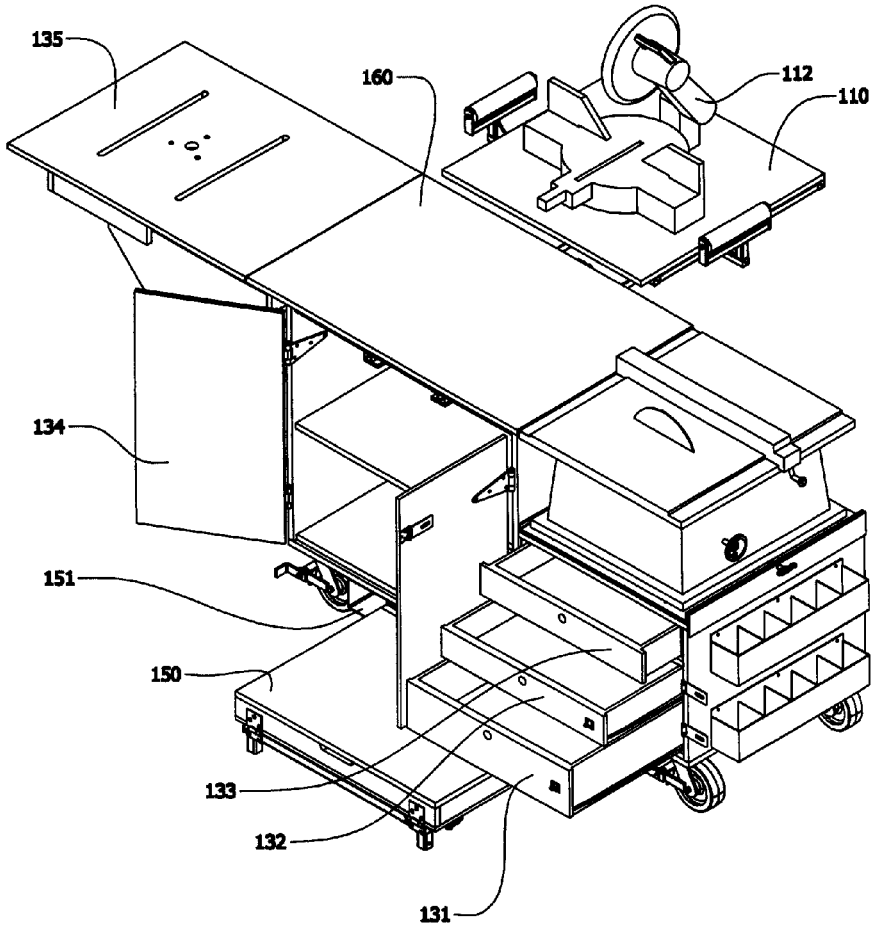
FIG. 7 is an all-open top right isometric view of the carpentry workshop of the invention from its front.
Figure 8:
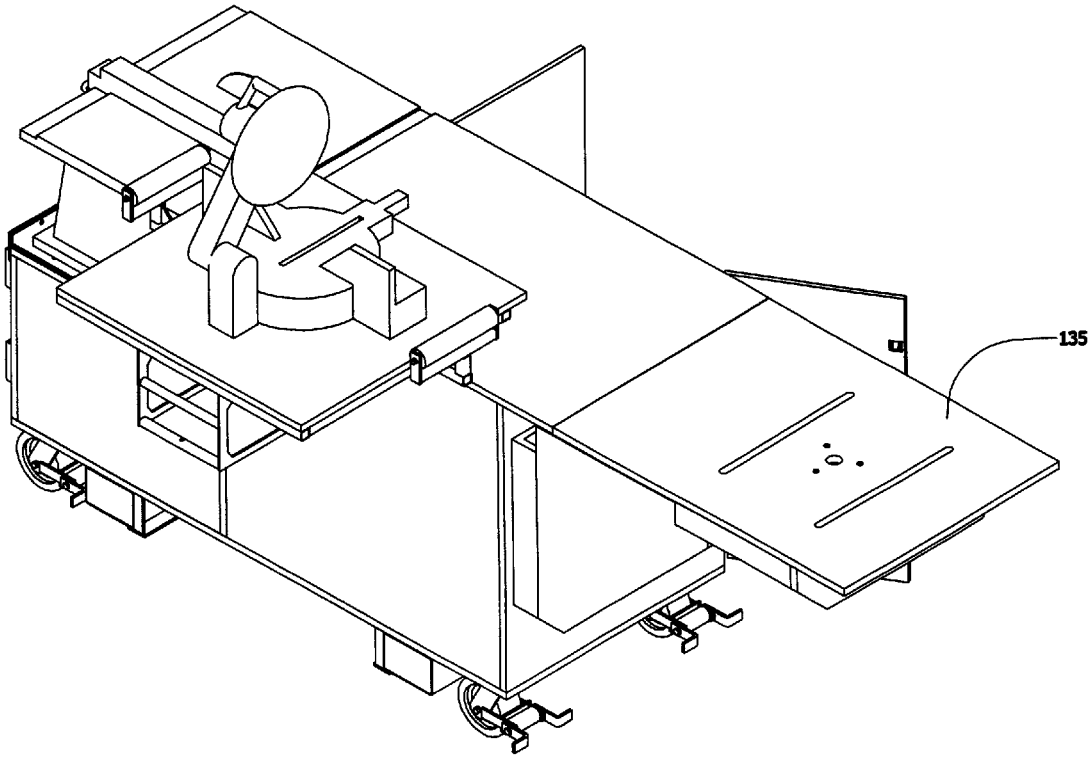
FIG. 8 is an all-open rear isometric view of the carpentry workshop of the invention.
Figure 9:
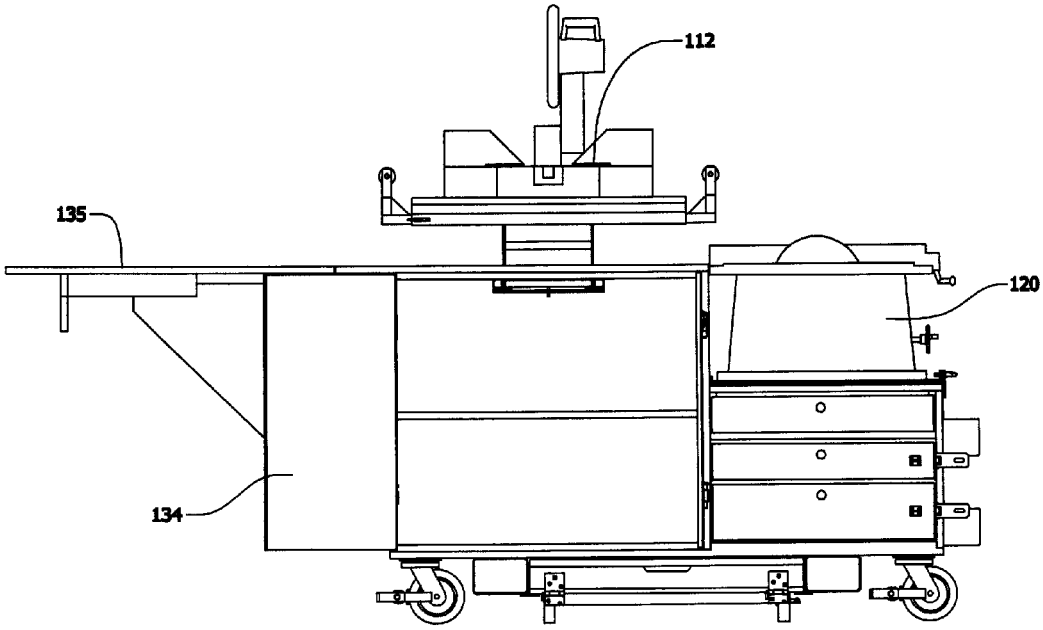
FIG. 9 is an all-open front view of the carpentry workshop of the invention.
Figure 10:
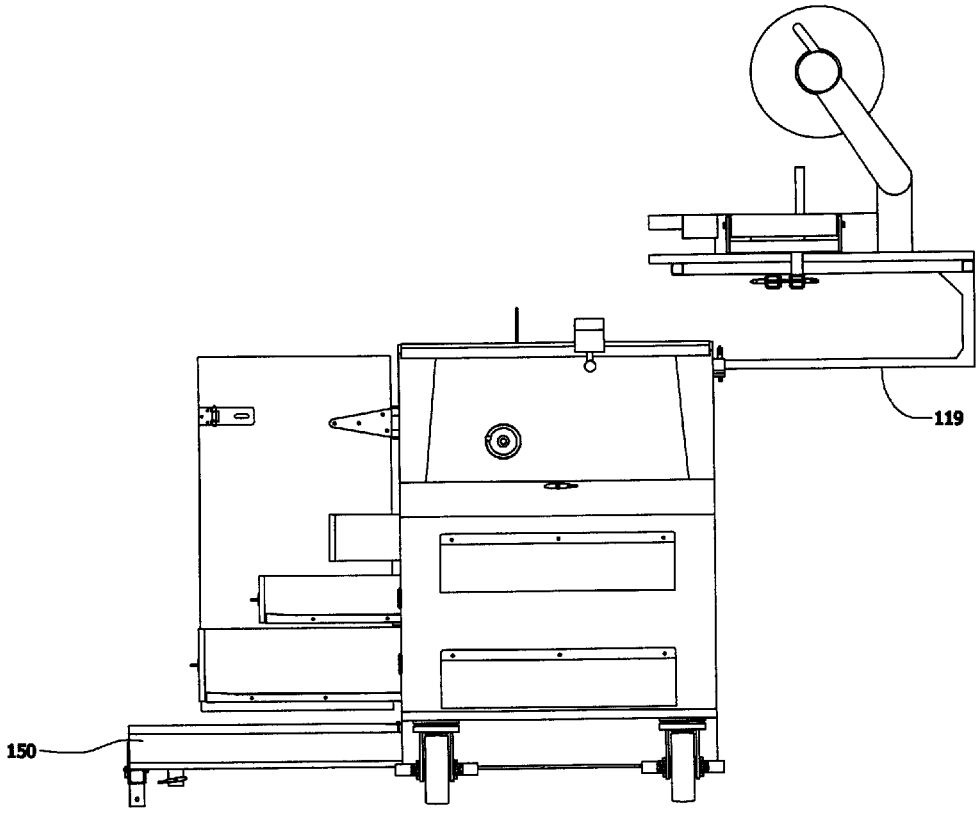
FIG. 10 is an all-open right side view of the carpentry workshop of the invention.
Figure 11:
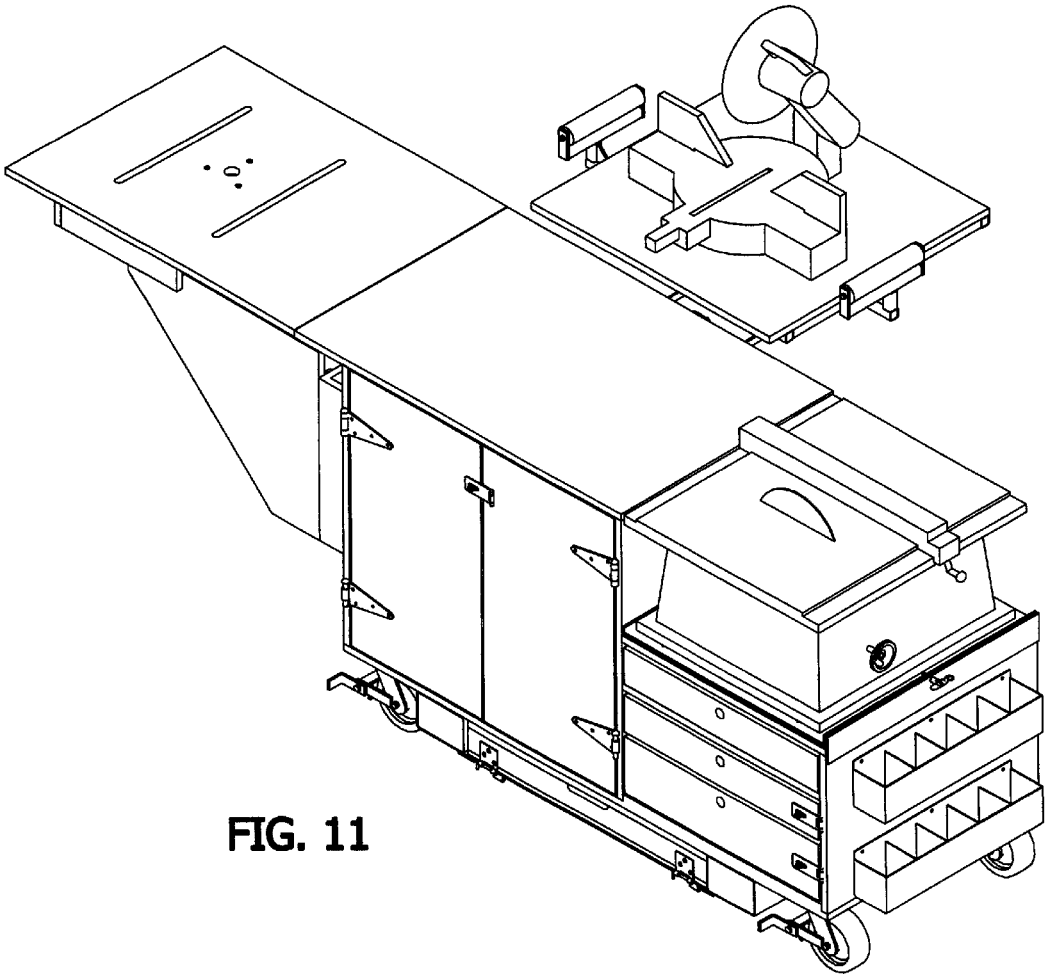
FIG. 11 is a top right isometric view of the carpentry workshop of the invention showing the table saw in its centered position.
Figure 12:
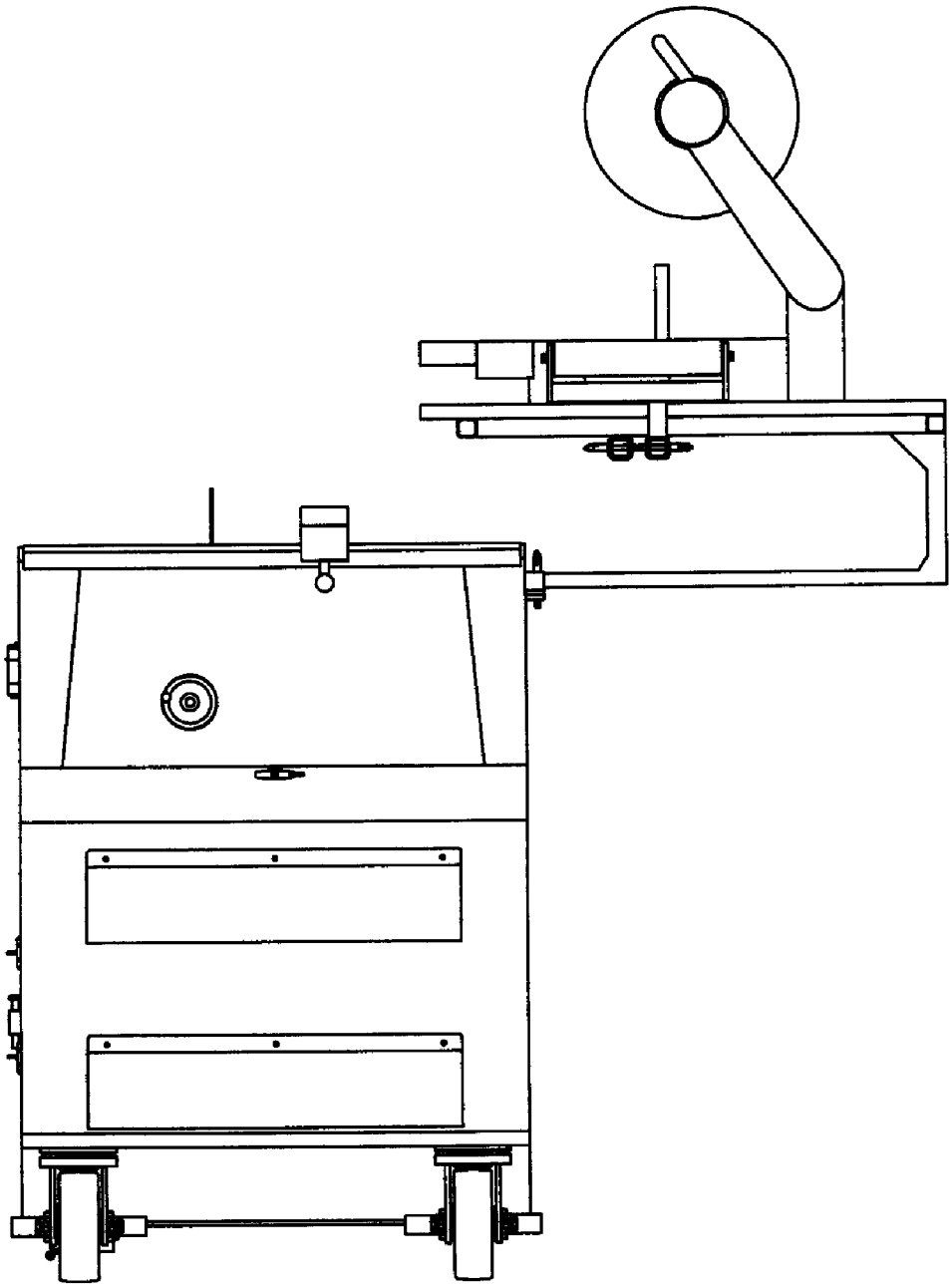
FIG. 12 is the side view of the same.

FIGS. 7-12 show the workshop of the present invention in all-open state. FIGS. 7 and 8 best illustrate extended storage drawers 131-133 and the doors 134 of the front storage area as well as a raised position of the extension outfeed table 135. Step/drawer 150 and the miter saw table 110 is also shown in its extended state on that Figure. FIG. 9 shows the front of the device as the table 135 is in its raised position. FIG. 10 shows extended drawers and a step on the left side of the device and the miter saw table extended on the right side of the device. FIGS. 11 and 12 illustrate that when the miter saw table is extended away from the workshop, there is virtually no interference between it and the main tabletop surface of the workshop so the use of the table saw and the miter saw can be done independently from one another.

Although the invention herein has been described with respect to particular embodiments, it is understood that these embodiments are merely illustrative of the principles and applications of the present invention. For example, instead of having a recess 161 to place a table saw on the workshop, an extension of the tabletop surface 160 is contemplated such that the table or circular saw can be suspended underneath it so that the blade extends therethrough. Appropriate sliding means allowing the saw to be shifted to the left and to the right of the longitudinal centerline of the workshop are also included in this extension. This ensures a similar operation of the table saw as described above. It is therefore to be understood that numerous modifications may be made to the illustrative embodiments and that other arrangements may be devised without departing from the spirit and scope of the present invention as defined by the appended claims.

What is claimed is:

1. A portable carpentry workshop comprising a main structural body equipped with a tabletop portion having a top sawing surface, said workshop further including a recess portion, said workshop having a length at least two times greater than a width and defining a longitudinal centerline extending through both said tabletop and said recess portions, said recess portion further equipped with a sliding means for slidingly accepting a table saw therewith, said table saw having a sawing table on top thereof, said recess portion is located such that the sawing table of said table saw is aligned on the same level with the sawing surface of said tabletop portion forming in combination a main sawing tabletop surface of said workshop, said sliding means further adapted to allow sliding the position of said table saw from a normally centered position along said longitudinal centerline to either left or right from said centerline.

2. The carpentry workshop as in claim 1, wherein said table saw is positioned such that a blade of said table saw is oriented along said longitudinal centerline of said workshop.

3. The carpentry workshop as in claim 1, wherein said table saw is characterized by a height, said sliding means are located lower than said sawing surface of said tabletop portion by a distance equal to the height of said table saw, whereby when positioned on top of said sliding means, the sawing table of said table saw is aligned on the same level with the sawing surface of said tabletop portion.

4. The carpentry workshop as in claim 1, wherein said sliding means are positioned on the same level with said sawing surface of said tabletop portion, said sliding means are adapted to mount said table saw underneath thereof, whereby when said table saw is mounted to hang down from said sliding means, the sawing table of said table saw is aligned on the same level with the sawing surface of said tabletop portion.

5. The carpentry workshop as in claim 1, wherein said main structural body is further equipped with a longitudinally extendable outfeed table aligned with said tabletop portion when in extended position to further increase the length of said main sawing tabletop surface.

6. The carpentry workshop as in claim 1 further comprising an extendable miter saw table located above said tabletop portion and extendable to the side thereof.

7. The carpentry workshop as in claim 6, wherein said miter saw table is located above said tabletop portion at a distance from about three to about ten inches.

8. The carpentry workshop as in claim 6, wherein said miter saw table is equipped with a pair of outfeed supporting rollers, each supporting roller is mounted on a corresponding supporting means slidingly attached to said miter saw table, whereby said outfeed rollers are individually extendable longitudinally along said centerline of said workshop on both sides of said miter saw table.

* * * * *